United States Patent [19]

Haselton

[11] 3,986,471

[45] Oct. 19, 1976

[54] SEMI-SUBMERSIBLE VESSELS

[76] Inventor: Frederick R. Haselton, 1205 Fallsmead Way, Rockville, Md. 20854

[22] Filed: July 28, 1975

[21] Appl. No.: 599,751

[52] U.S. Cl. ..... 114/.5 D; 114/122

[51] Int. Cl.[2] ..... B63B 35/44; B63B 39/06

[58] Field of Search ..... 114/.5 D, 126, 209, 114/206 R, 121, 122; 9/8 P

[56] References Cited

UNITED STATES PATENTS

| | | | |
|---|---|---|---|
| 1,096,192 | 5/1914 | Pleva | 114/121 |
| 2,399,656 | 5/1946 | Armstrong | 114/.5 D |
| 3,673,974 | 7/1972 | Harper | 114/.5 D |
| 3,708,991 | 1/1973 | Barkley | 114/121 |
| 3,807,335 | 4/1974 | Talkington | 114/121 |
| 3,896,755 | 7/1975 | Marbury | 114/126 |

*Primary Examiner*—Trygve M. Blix
*Assistant Examiner*—Gregory W. O'Connor
*Attorney, Agent, or Firm*—Pollock, Vande Sande & Priddy

[57] ABSTRACT

An apparatus for damping vertical movement of a semi-submersible vessel having a small waterplane area, whose buoyancy is provided substantially completely by submerged pontoon means and which includes at least one submerged damper plate having valves or similar flow controllers therein for providing substantially greater resistance to upward movement of the plate than downward movement. The damper plate is supported deep beneath the semi-submersible vessel by flexible, tensioned support elements such as chains or cables, at a depth beneath the water surface in the semi-submerged condition of the vessel, at which depth the amplitude of subsurface wave motion is less than the maximum heave amplitude which would be experienced by the semi-submersible vessel alone under identical sea conditions. The area of the damper plate is several times larger than the waterplane area of the vessel. An upward only-damping action is achieved due to the entrainment of large apparent masses of relatively still water by the damper plate.

26 Claims, 12 Drawing Figures

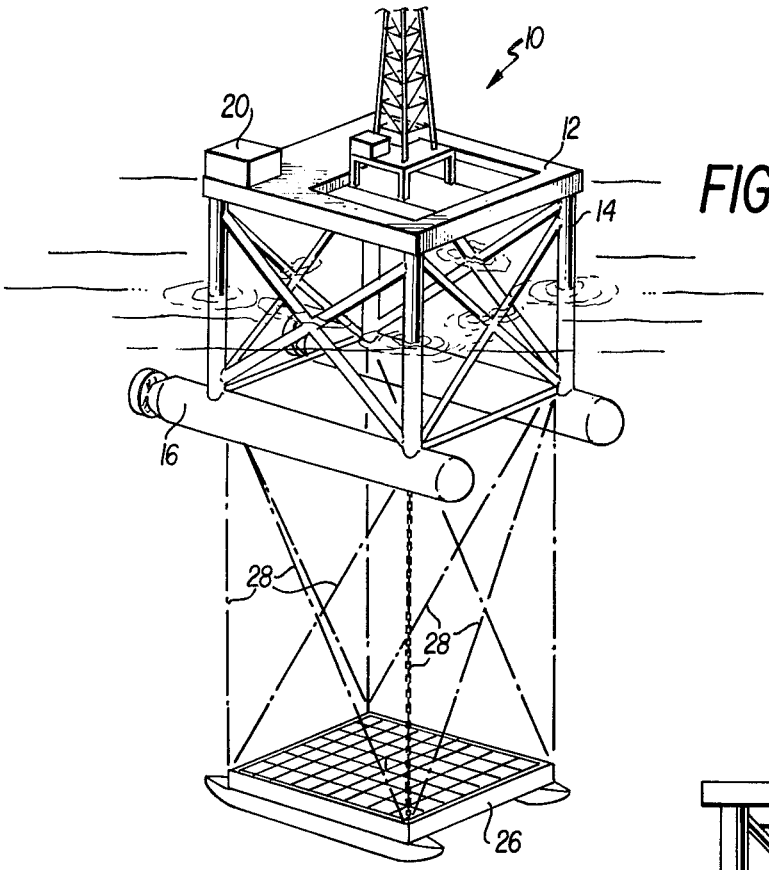
FIG. 3
FIG. 8
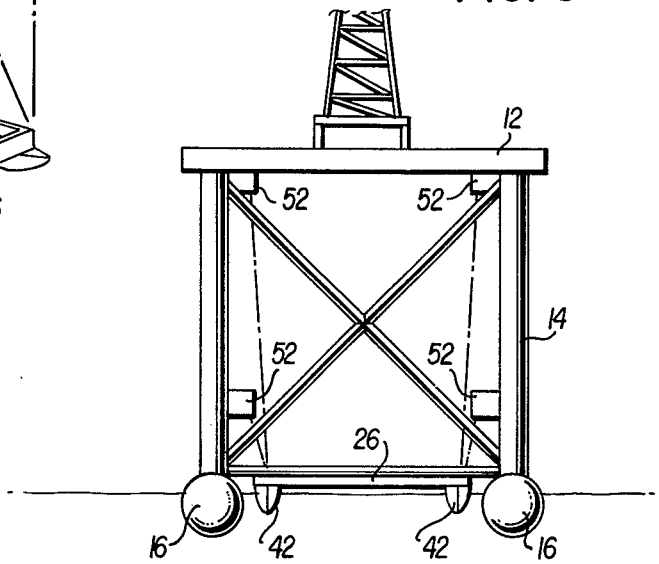
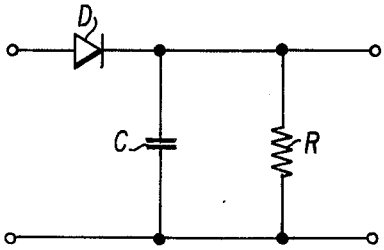
FIG. 4B
FIG. 4A
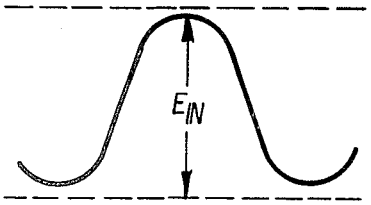
FIG. 4C
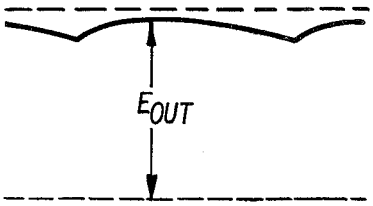

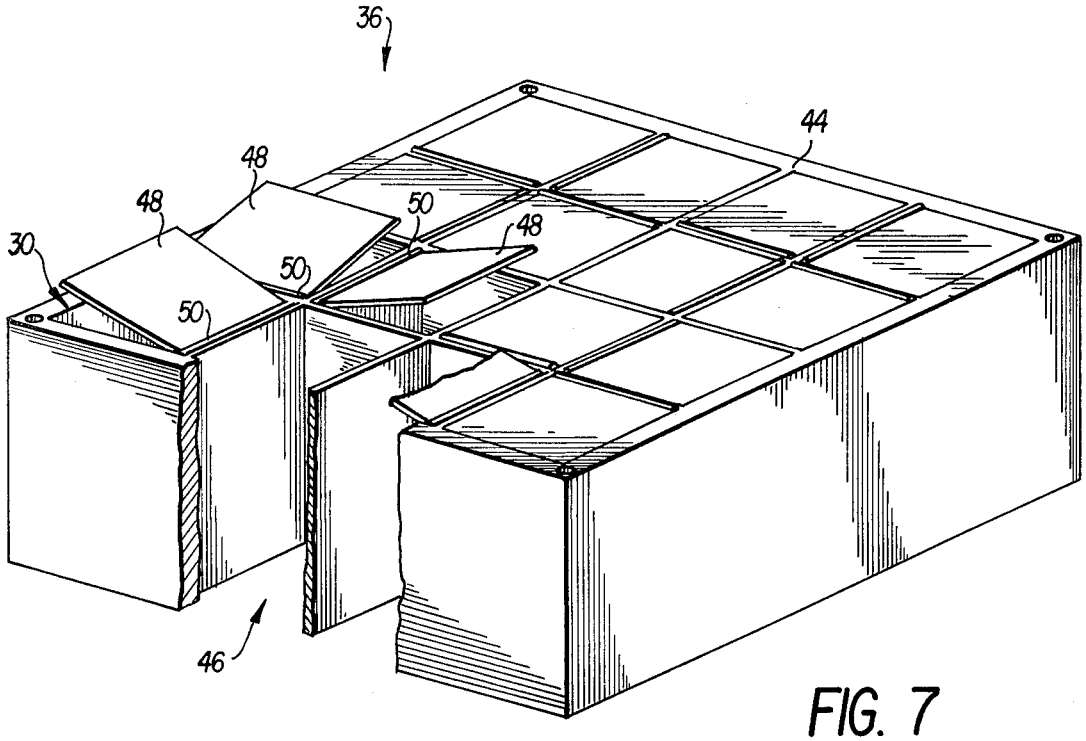
FIG. 7
FIG. 9
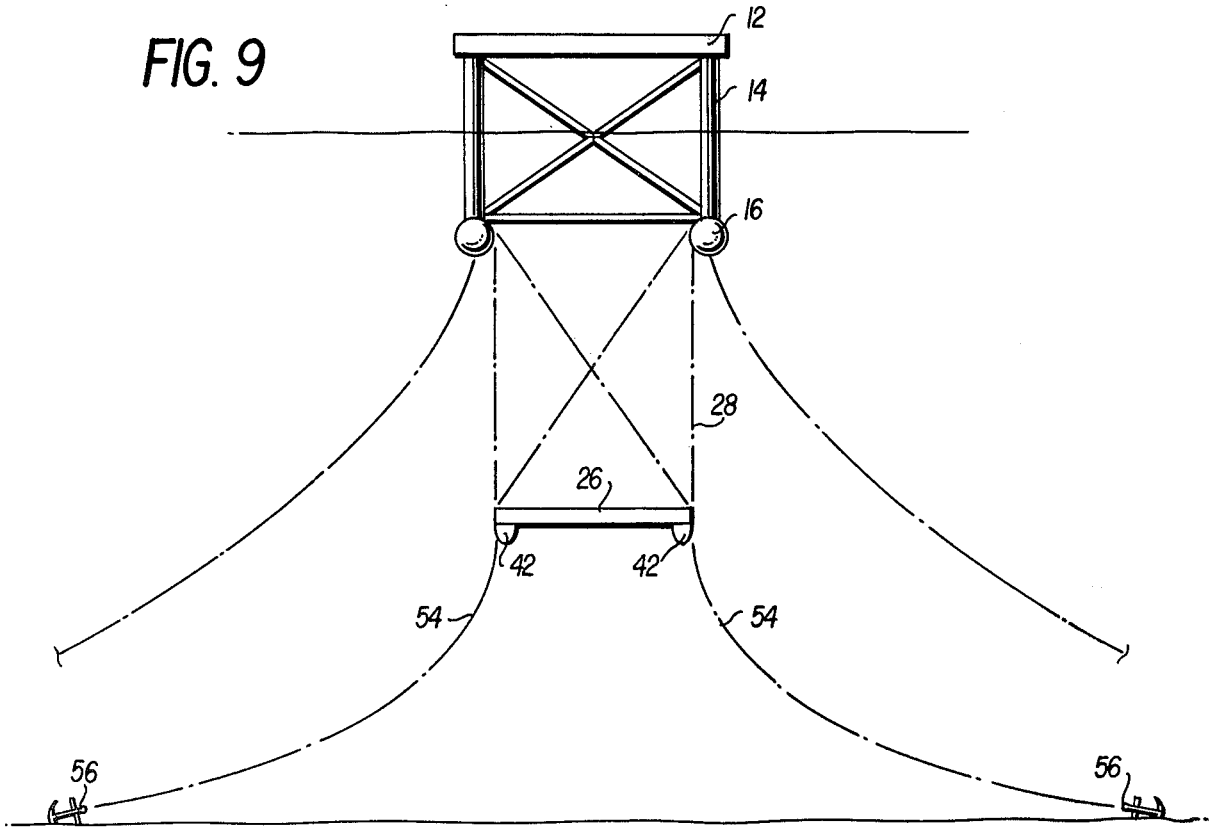

SEMI-SUBMERSIBLE VESSELS

BACKGROUND OF THE INVENTION

In recent years, changes in world political structure have provided the major oil producing countries with tremendous economic power over the highly industrialized countries which depend to a great extent on them for fuel. Although efforts have been under way for some time to improve oil prospecting and recovery methods and equipment to enable alternative oil sources to be discovered and exploited, the recent political and economic pressures have added a particular sense of urgency to the search.

One approach which has received considerable attention in the past ten or fifteen years is the use of various types of off-shore well-drilling platforms. More particularly, mobile, semi-submersible drilling platforms have been used. These are considered preferable to stationary platforms since the semi-submersibles are not dependent upon the presence of suitable ocean bottom structure for a support foundation, and may be moved rather easily from one drilling site to another. A notable disadvantage of semi-submersible drilling platforms, compared to the stationary type, is their inherent tendency to rise and fall with the sea waves as the waves move past the drilling station. Any relative motion between a drilling platform and the earth is undesirable, of course, since the length of the drill string must somehow accommodate to the changes. Where the changes are large and frequent, this can present serious impediments to continuous drilling.

Modern semi-submersibles are designed to reduce heave, pitch and roll motions through the use of large size and mass supported by submerged buoyant bodies which are coupled to the drilling platform by columns having a relatively small waterplane area. Due to the small waterplane area and large mass of present-day semi-submersibles, passing waves subject the device to only small driving forces which lead to small accelerations and short displacements. The heave motion which remains may frequently be compensated for, at least in part, through the use of drill string heave compensators, as is known in the art.

Unfortunately, there occur sea states which override present-day capabilities to deal with heave and require drilling operations to cease. Daily operation costs for the semi-submersible and its crew continue, however, and may amount to annual losses in the millions of dollars. Various solutions to these problems have been suggested. First, much larger platforms could be used to create a more favorable ratio of platform mass to wave energy. Theoretically, this approach has promise; however, the much higher construction and operation costs and anticipated structural limitations severely limit the amount of additional mass which may be economically provided. Second, it has been proposed to provide active six-degree-of-freedom hydrodynamic controls for known semi-submersibles. This approach may have some promise for future semi-submersibles, but is not clearly applicable to existing platforms or those already planned and being built. Third, a type of more effective passive damping system could be provided, which preferably would be retrofitable to existing semi-submersibles. The present invention concerns a unique type of retrofitable passive damping system.

Present-day semi-submersibles usually include heave damping structure in the form of the flat deck surfaces of the submerged hulls or pontoons. Unfortunately, these surfaces are too small in area and located at too shallow a draft to reduce heave significantly, especially in very heavy weather. To locate the pontoons at greatly increased depths on the type of rigid support legs in use today would create severe structural design problems and render the vessel far less stable in the floating condition. One such prior art system is shown in an article in *Ocean Industry*, August, 1971 by Jack R. Hilder, Jr. Another prior art system is shown in U.S. Pat. No. 3,673,974, granted to James C. Harper in July, 1972, which discloses a semi-submersible having a perforated mat submerged to a shallow depth for stabilization. The mechanical complexity of these systems, coupled with the substantial difficulty of retrofitting existing platforms, may be responsible for their slow acceptance by the off-shore drilling community.

It is also known in the prior art to provide a flat plate suspended at a shallow draft below the surface of the water and attached to a vessel having a conventional, surface vessel or displacement type hull. As will be shown hereinafter, in order for a submerged plate to have a significant effect in stabilizing the heave motion of a vessel, it is necessary that the area of the submerged plate be a multiple of the waterplane area of the vessel. In surface vessels having displacement-type hulls, the waterplane area is necessarily very large, since obviously all of the vessel's buoyancy is provided by the hull's displacement at and near the water's surface. Consequently, a submerged plate to provide effective heave motion stabilization must have an overall area as much as several times greater than the waterplane area of the vessel. It will be apparent that plates of this size are entirely impractical for displacement-type surface vessels. Where, as with the present invention, the vessel is one having a semi-submersible type hull, the waterplane area is very small compared to a surface vessel of equal mass. This makes it possible to provide a submerged damper plate whose area is many times greater than the waterplane area and yet have the outer dimensions of the submerged plate be, in most instances, no greater than the dimensions of the vessel itself. Thus, the plate can readily be accommodated under the vessel and can even be stored thereunder, in an elevated position, when the vessel is being transported from one site to another.

Typical examples of prior art disclosures wherein submerged plates are applied to surface vessels having displacement-type hulls comprise the Pleva U.S. Pat. No. 1,096,192 and Farquhar U.S. Pat. No. 283,091. In view of the above considerations, the teachings of these patents are not considered as being applicable to the present invention. In the case of the Pleva patent, moreover, the suspended plate is positioned at only a slight distance below the bottom of the boat to which it is attached. Such shallow deployment of the plate is obviously essential in Pleva for the hull to be maintained in a floating condition. More particularly, one can readily visualize that, in Pleva, if the plate were positioned sufficiently below the boat so as to be located in relatively still water, regardless of surface conditions, in the presence of wave action the suspended plate would readily be lowered in the water as the boat itself is lowered in a wave trough. Unfortunately, the plate and the attached boat would be prevented from rising as the crest of a wave approaches, thereby swamping the boat. Accordingly, it is essential, in order for Pleva's disclosure to be operable, that the plate be suspended at a relatively shallow depth. In the case of Farquhar, the damper plate is rigidly suspended beneath the vessel which would cause very high compression loadings in the support and would require the use of impractically heavy structure to sustain the compression loads. Moreover, the area of Farquhar's plate is so small as to provide negligible damping effect.

According to basic wave theory, the vertical component of water wave particle motion decays exponentially with depth such that motion is halved for every increase in depth below the mean water surface of one-ninth of the wave length in the deep ocean. Virtually all motion ceases below 100 meters, even in the most violent storms. Also, it is known that increased wave amplitudes are accompanied by longer ocean wave lengths and periods; whereas, the heave response of conventional semi-submersibles increases markedly as ocean wave periods approach the heave resonance period of the semi-submersible. Thus, conventional semi-submersibles, even those having shallow draft dampers as discussed above, are subject to large heave excursions during sea conditions frequently encountered above known submerged oil fields, such as in the North Sea.

OBJECTS OF THE INVENTION

An object of the invention is to provide a simple means for damping motion of semi-submersible vessels by increasing their apparent mass during heave motion, which may be easily retrofitted to existing platforms while they are on station.

Another object is to provide such a damping means which may be withdrawn from its operating position to a stored position during transportation of the semi-submersible vessel.

A further object is to provide such a damping means with ballastable and deballastable hulls for use in transporting and deploying the device.

Yet another object is to provide such a damping means with removable damping substructures to facilitate on site repair of the device.

A still further object of the invention is to provide such a damping means for reducing motion of semi-submersible vessels to levels which permit continuous drilling operation under the worst anticipated sea states.

Another object of the invention is to provide means for ballasting and deballasting the semi-submersible as a function of the damping force applied by the device.

Still another object of the invention is to provide such a damping means which has a high resistance to upward movement of the vessel and a low resistance to downward movement, to permit the use of flexible support members.

These objects of the invention are merely exemplary; thus, those skilled in the art may recognize other problems solved by, or inherent advantages achieved by, the invention. Nonetheless, the scope of the invention is to be limited only by the appended claims.

SUMMARY OF THE INVENTION

The above objects and other advantages are achieved with semi-submersible vessels incorporating damping plates according to the present invention. Semi-submersible vessels typically comprise a platform element for supporting supplies, equipment and the like at an above-water location and support columns extending beneath the platform element and having a waterplane area large enough to ensure stability when the apparatus is in a semi-submerged condition. At least one buoyant, ballastable support structure is commonly secured to the support columns, the combination of the platform, the support columns and the buoyant, ballastable support structure being buoyantly supported in a semi-submerged condition primarily due to the buoyancy of the buoyant, ballastable support structure. Means are provided for ballasting and deballasting the buoyant, ballastable support structure to produce alternatively semi-submerged and floating conditions of the combination. Such a combination will have a maximum heave amplitude occurring in response to open sea waves which have a period essentially equal to the natural heave period of the combination. Attached to this combination according to the present invention, are a plurality of support members which extend beneath the combination to a depth below the surface of the water in the semi-submersed condition at which the amplitude of subsurface wave motion is less than the maximum heave amplitude of the combination alone. Attached to the support members is a damper means for providing low resistance to downward movement of the combination and considerably higher resistance to upward movement in response to open sea waves. In one embodiment, the damper means comprises at least one essentially rigid plate attached to the support members, the plate including means for permitting a greater flow of water upwardly than downwardly therethrough. The support members are preferably flexible, tensioned elements such as chains or cables. To prevent sway and surge of the plate relative to the combination, the flexible, tensioned cables or chains are preferably cross-rigged.

The damper plate preferably comprises a matrix of support beams joined in a rigid frame which includes a plurality of removable check valve substructures, each including a plurality of upwardly opening check valves. The check valves are hinged to the damper plate in staggered orientations to minimize transverse movement of the plate as water moves upward through the flapper valves.

BRIEF DESCRIPTION OF THE DRAWINGS

FIG. 3 shows a semi-submersible embodying a damping means according to the invention.

FIGS. 4A to 4C show an analogous electrical circuit.

FIG. 7 shows a perspective view, partially broken away, of a flapper-valve substructure.

FIG. 8 shows the damper plate in its stowed position for transport.

FIG. 9 shows the conventional method and a preferred anchoring arrangement for a semi-submersible embodying the invention.

DETAILED DESCRIPTION OF THE PREFERRED EMBODIMENTS

Figure 1:
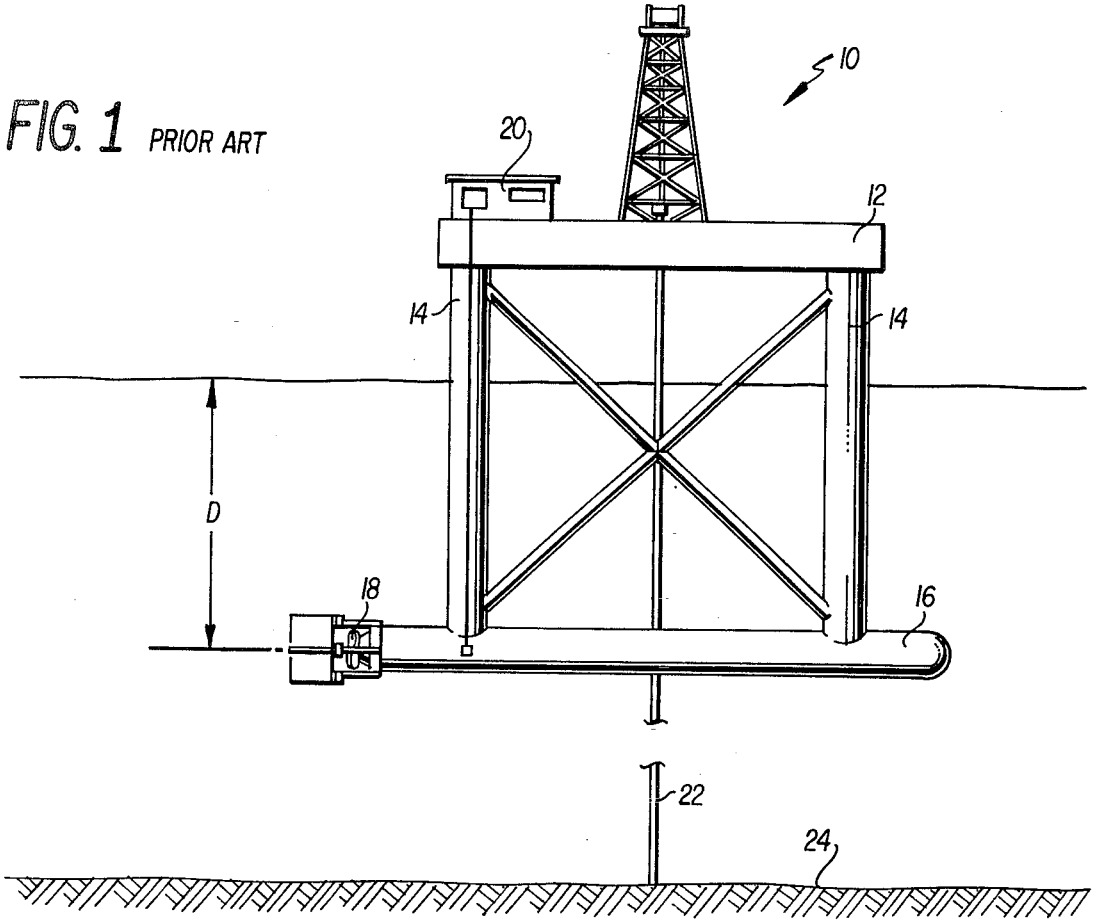
FIG. 1 PRIOR ART
FIG. 1 is a perspective view of a typical prior art semi-submersible.

There follows a detailed description of the various embodiments of the invention, reference being made to the drawings, in which like reference numerals identify like elements of structure in each of the several Figures.

FIG. 1 shows a schematic view of a prior art semi-submersible drilling platform 10 deployed at a drilling site in its semi-submerged condition. A platform 12 is provided on which may be mounted crew's living quarters, well-test equipment, pipe racks, pilot house, cranes, the drilling derrick, a helicoptier deck and similar conveniences as is known to those skilled in the art. Platform 12 is supported by a plurality of support columns 14. When the semi-submersible is in its illustrated submersed condition, columns 14 extend beneath the surface of the water to a depth D where they are joined to a plurality of buoyant, ballastable support structures or pontoons 16. Usually, a pair of spaced pontoons 16 are used. Means such as electric motors are provided in the pontoons for driving propellers 18, which permit the semi-submersible to be moved from drilling site to drilling site in its floating condition (not shown). A ballasting and deballasting system 20, such as a compressor and air flasks and associated valving and piping, is provided to lower the semi-submersible from its floating position by flooding pontoons 16 and to raise it to its floating position by blowing air into, or pumping water out of, pontoons 16, as will be understood by those skilled in the art. Of course, pontoons 16 may be partially ballasted or deballasted as necessary to maintain the desired draft D in operation; however, the buoyancy of the semi-submersible is provided at all times primarily by the pontoons. A drill string 22 is extended between pontoons 16 to the ocean floor 24 during drilling operations.

Figure 2:
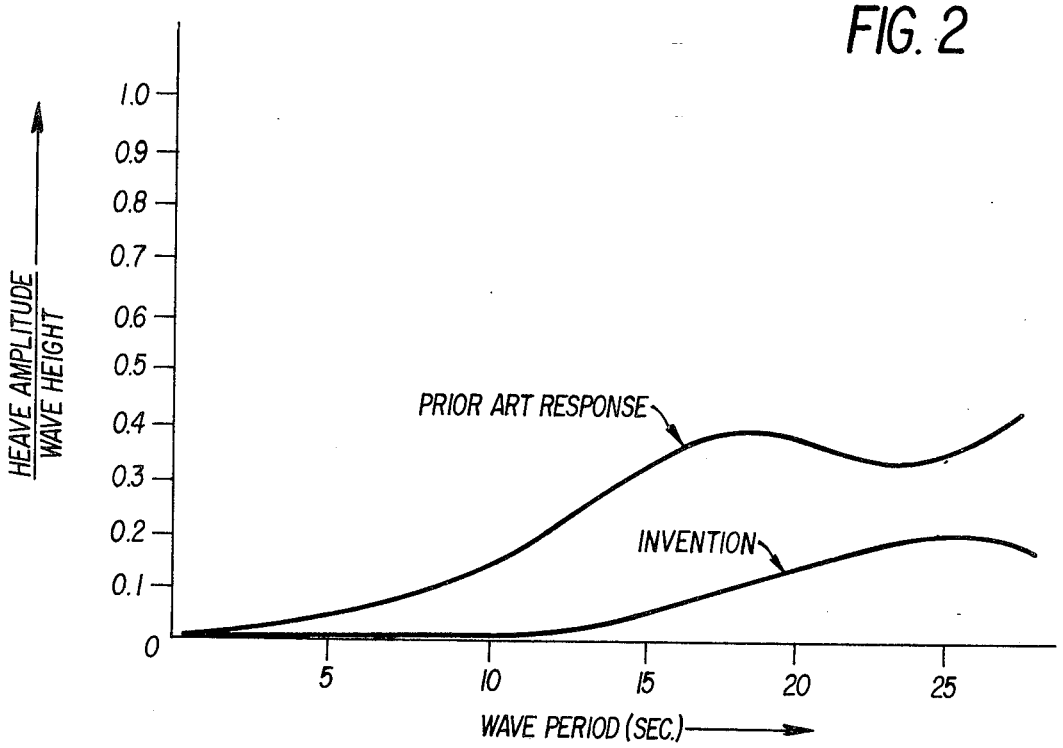
FIG. 2 is a plot showing heave response as a function of wave period, for the prior art and the invention.

As previously mentioned, such prior art semi-submersibles are subject to substantial movement in the vertical direction, or heave, under extreme conditions in the open ocean. This can require that drilling operations cease, with attendant cost increases and lost time. Several factors contribute to this undesirable movement: (a) the total platform mass, including ballast and the added apparent mass of the water caused to move by the pontoons and columns; (b) the total waterplane area presented by all columns and cross-structures where they pierce the surface; (c) the forcing function generated by waves moving past the platform; and (d) drag or friction forces caused by relative motion between the water and the submerged portion of the platform. Where $h$ is the wave height above mean water level; A is the waterplane area; M is the total platform mass; and $a$ is the upward acceleration imparted to the semi-submersible by the wave motion, the behavior of a prior art semi-submersible may be approximated by the relationship $$hA \propto Ma,$$

which is simply Newton's law of motion. Were it not for friction and the physical height limitations of the semi-submersible, the heave amplitude would reach an unacceptably high value when the period of the waves exactly equals the natural heave period of the semi-submersible. The actual behavior of such prior art semi-submersibles is illustrated in FIG. 2, where it is seen in the curve labeled PRIOR ART RESPONSE that the heave amplitude of the prior art semi-submersible reaches a maximum of about 40% of the wave height of open sea waves having a period of 15 to 20 seconds. This period is a common value for the natural heave period of prior art semi-submersibles.

In accordance with the above relationship, a substantial increase in the mass M would result in a much smaller acceleration. The waterplane area A is chosen to ensure that the semi-submersible will remain stable as loads are moved about on the platform. If the platform loads were unvarying, A could be made very small, as will be understood by those in the art. The dependency of heave response on system mass is illustrated in the lower curve labeled INVENTION in FIG. 2, where heave amplitude is reduced by a factor of nearly four in a system having an additional mass provided by a damper plate having an area of about ten times the waterplane area of the semi-submersible. The present invention concerns means for providing an apparent increase in the mass of the semi-submersible, whereby such reductions in heave amplitude may be attained.

FIG. 3 shows a schematic, isometric illustration of a semi-submersible embodying the present invention. An essentially rectangular damper plate 26 is suspended deep beneath the semi-submersible by a plurality of flexible support members 28, which may be cables or chains. Other plate shapes or a plurality of plates may also be used. A plurality of upwardly opening flapper valves 30 (see FIG. 7) are included in damper plate 26 for providing low resistance to downward movement of the plate and high resistance to upward movement, whereby the semi-submersible may move downward relatively easily but is restrained from upward movement by the large apparent mass entrained by the plate. To prevent sway and surge of the damper plate 26, some of the cables or chains 28 are cross-rigged fore to aft and port to starboard, as indicated. Thus, plate 26 always remains in fixed orientation relative to the semi-submersible under conditions wherein all cables or chains 28 remain in tension.

The depth of deployment of damper plate 26 is an important feature of the invention. As discussed previously herein, a semi-submersible without a damper plate will experience a characteristic worst case heave amplitude of about 40% of the height of the waves driving it at the heave resonance period. Thus, it is desirable to deploy the damper plate at a depth below the surface of the water at which depth the amplitude of subsurface wave motion is less than the maximum heave amplitude of a semi-submersible with no damping plate. At depths above this point, the heave response would be worse with the damper plate than without it. Since the amplitude of subsurface wave motion is halved for every one-ninth of a wave length drop in depth, as previously discussed, support members 28 preferably have in the preferred embodiment, a length of from one-fourth to one-third the wave length of open sea waves whose period is essentially equal to the natural heave period of the semi-submersible with no damping plate. Greater depths are also within the scope of the invention; however, depth in this range will ensure acceptable heave amplitudes.

The fact that damper plate 26 offers damping to movement upwardly is due principally to the mass of the water which is influenced by the plate's motion. This can be shown to be equal, in the case of an equivalent circular disc in an infinite medium, to $2/\pi$ times the mass of a sphere of water having the same radius as the equivalent disc. Thus, the entrained mass increases in proportion to the cube of the equivalent radius. For sea water, a rectangular plate 76 meters by 45 meters is approximately equivalent to a 66 meter disc which will entrain an apparent mass of about 95,593 long tons. Since such a damper plate is of a size suitable for use with many existing semi-submersibles, its effectiveness in adding mass to the system to reduce heave amplitude is apparent.

Increasing the apparent mass of the semi-submersible vessel thus may be achieved by placing a damper plate sufficiently below the surface to effectively entrain a large mass of water, which, at least at the depth of the damper plate, is relatively free from surface wave induced motion.

According to the present invention, the desired increase in apparent mass is obtained by providing a large area damper plate supported on cables or chains, and having sufficient negative bouyance to maintain the cables or chains in tension, the plate having a large number of check or flapper valves which open when the plate moves downward and close when it moves upward. The flow resistance of the damper plate with the flapper valves open must be sufficiently low to minimize downward drag of the damper plate and permit the weight of the damper plate to maintain the chains or cables in tension, even during maximum velocity downward movement of the semi-submersible during any sea state. As the semi-submersible begins to rise, however, the valves close and the increased tension in the support members, caused by the resistance of the entrained water, restrains upward motion of the semi-submersible. The semi-submersible is thus pulled downward against its supporting columns, causing the columns to submerge to a greater depth. This change in draft increases the buoyancy of the device. This type of "ratchetting" action occurs as successive waves pass until a balance is reached between the average force generated by the increased buoyancy and the average force required to move the entrained water.

An analogy exists between the mode of operation of the present invention and a common electrical half-wave rectifier as shown in FIGS. 4A to 4C. Capacitor C is charged with a DC voltage equal to the peak to peak value of the AC voltage shown in FIG. 4A. Diode D allows electrical current flow in only one direction, and the resistance R tends to discharge capacitor C. The voltage across capacitor C represents the increase in average total downward force exerted by the damper plate according to the invention and the capacitance of capacitor C represents the total upward moving mass including the water entrained by the damper plate. The diode D represents the one-way actions of the flapper valves. The resistance R represents the resistance to upward movement of the semi-submersible and damper plate. Finally, the AC input voltage represents the input waves motion; and the rectified output voltage, the movement of the semi-submersible and damper plate.

Figure 5:
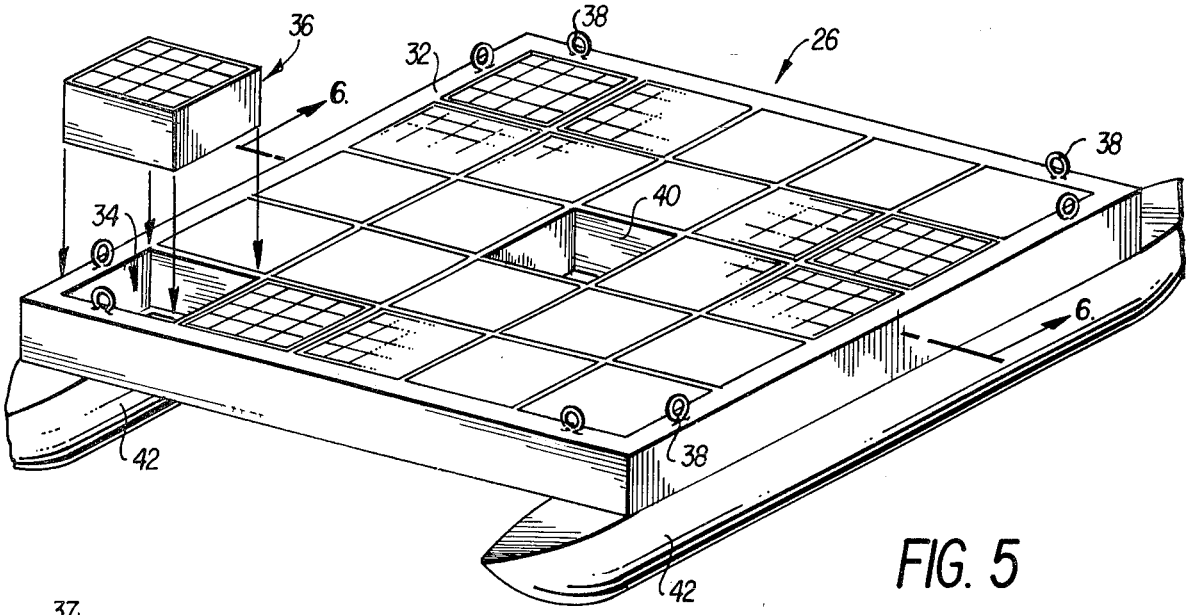
FIG. 5 shows a perspective view, partially exploded, of the damping plate according to the invention.
Figure 6:
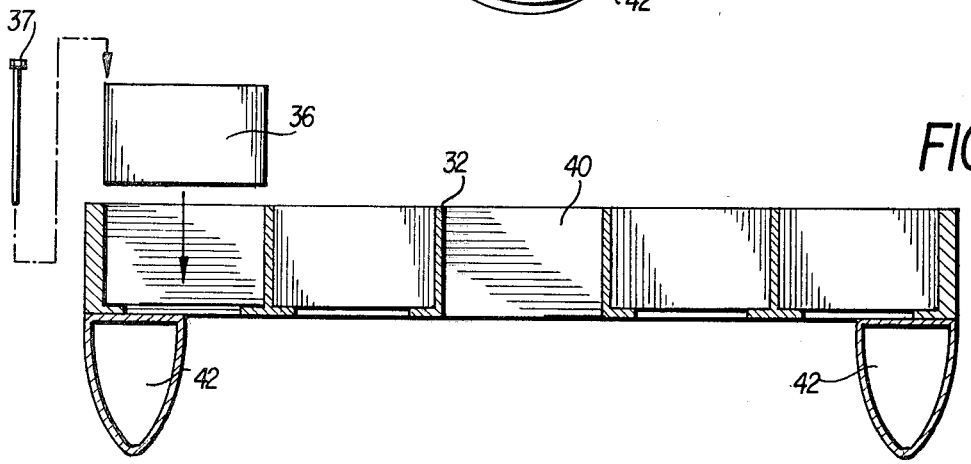
FIG. 6 shows a view taken along line 6—6 of FIG. 5.

FIGS. 5 to 7 illustrate schematically the essential details of damper plate 26. Plate 26 is preferably a single rigid plate; however, more than one plate similarly deployed beneath the semi-submersible may be used, if desired. A framework 32 of steel or reinforced concrete beams is provided which forms a matrix or "egg-crate" of rectangular cells 34, for supporting a plurality of removable check or flapper valve substructures 36. Fasteners such as bolts 37 may be used to secure substructures 36 to framework 32. A plurality of pad-eyes 38 for attachment of support members 28 are provided around the circumference of framework 32. A central opening 40 is provided to accommodate the drill string and other equipment.

Although it is within the scope of the invention to suspend only framework 32 and substructures 36 beneath a semi-submersible, the preferred embodiment includes a pair of spaced catamaran hulls 42 which may be used to support the damper plate while it is towed to an operating semi-submersible for on-site installation. Hulls 42 may be provided with ballasting and deballasting equipment to facilitate lowering and raising the damper plate beneath a semi-submersible.

Referring to FIG. 7, the structure of flapper valve substructures 36 may be understood. Each substructure consists of a smaller matrix or "egg-crate" frame 44, defining a plurality of preferably rectangular cells 46 which extend therethrough. Each cell 46 is closed at its upper end by a simple flapper valve 48, hinged along one side of the cell as indicated at 50. To minimize any tendency for the damper plate to be forced laterally due to upward movement of water through valves 48, hinges 50 are staggered so that adjacent flapper valves 48 open in different directions. Although flapper valves are illustrated, other types of valving arrangements may be used without departing from the scope of the invention, so long as their function is to provide sufficiently low resistance to downward movement of the damper plate to maintain tension on cables 28 and much higher resistance to upward movement to provide added apparent mass. In some instances, it may be desirable to provide through holes in the damper plate without flow controls, when it is desired to lessen the damping effect of the damper plate.

FIG. 8 shows schematically the manner in which damper plate 26 may be stowed when the semi-submersible is in its elevated or full-floating position for movement to a new drilling site. A plurality of winches 52 are provided on platform 12 or support legs 14 or pontoons 16, as may be convenient, which are used to raise damper plate 26 to an out-of-the-water position between pontoons 16. In some instances, it may be feasible to moor damper plate 26 on its catamaran hulls 42, between pontoons 16; however, the above-water storage position is preferred to minimize friction drag loads on the propulsion plant of the semi-submersible.

As shown in FIG. 9, a semi-submersible having a damper plate 26 according to this invention may require the use of an alternative anchoring system. In conventional applications, mooring chains and anchors are payed out from the pontoons 16 of the semi-submersible, as indicated in phantom. If a damper plate 26 is used, however, strong subsurface currents could cause the damper plate to rock the entire drilling platform since the cross-rigged support chains would cause the semi-submersible to try to follow movement of the damper plate in subsurface currents. To counteract this, the mooring chains 54 and anchors 56 would be attached directly to the damper plate 26, as indicated. To provide for vertical movement, chains 52 should be provided with a large scope of from seven to eight times the distance from damper plate 26 to the ocean floor.

The application of the invention to a typical prior art semi-submersible will now be considered. For a semi-submersible having an opening between its pontoons of about 108 meters by 45 meters, a damper plate measuring 76 meters by 45 meters is selected. A 5 meter square opening is provided in the plate center for the drill string and other equipment. The effective plate area is thus about 3,400 square meters. When the device is deployed deep beneath the semi-submersible, as previously discussed, an added apparent mass of about 100,000 long tons is achieved. The added apparent mass if preferably at least as large as the total mass of the semi-submersible without the damper plate, to counteract buoyant forces. The maximum peak loading distributed among support members 28 is much less than this and is conservatively estimated by assuming a simultaneous step wave input to all support columns of a height of 20 meters. Assuming the support columns have a total cross sectional area of about 300 square meters, as would be typical, the resultant force due to the step input is approximately 6,100 long tons. To reduce heave amplitude significantly, the damper plate area should be at least 3 times the waterplane area of the semi-submersible. The resultant force is distributed over the damper plate area at about 0.91 long tons per square meter. Such a total force may be supported by 16 3-inch chains, with an 84% safety factor.

The deployment procedure would be to ballast the semi-submersible down to its normal drilling depth, during relatively calm weather. The damper plate would have previously been placed between the pontoons, as indicated in FIG. 8. The compartmented catamaran hulls 42 would then be partially flooded to give the damper plate sufficient negative buoyancy to permit it to be lowered to a depth of about 100 meters. Support members 28 would then be secured to attachment points on pontoons 16. Hulls 42 would then be fully flooded to assure that the support members remain in tension in all sea states. For recovery, hulls 42 would be blown at least partially dry to reduce the power requirement of winches 52.

Figure 10:
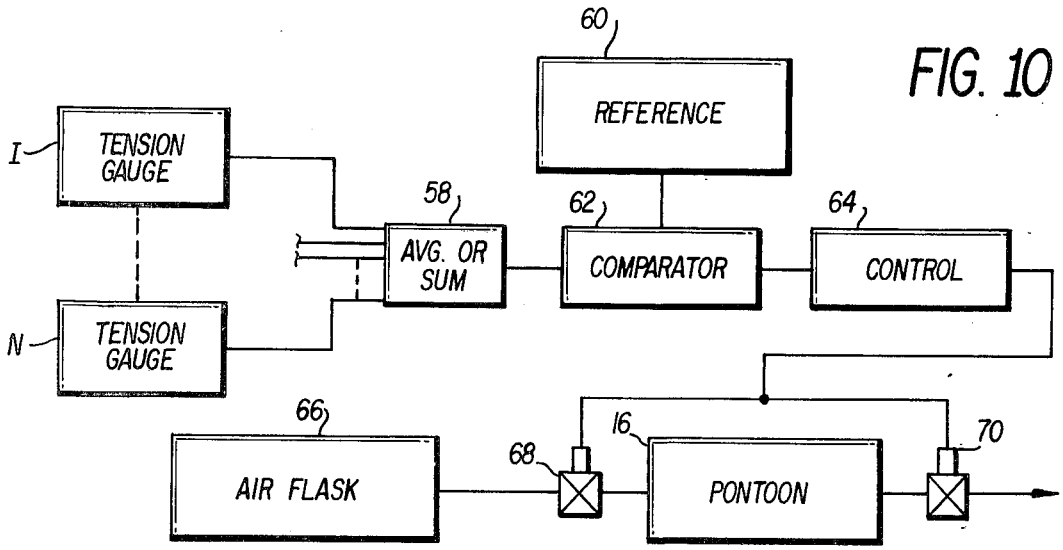
FIG. 10 shows a pontoon ballast control circuit diagram.

Due to the action of the damper plate 26, the semi-submersible will tend to increase in draft as the sea state increases. To control this tendency, support elements 28 are provided with tension sensing means such as strain gages, whereby the individual chain or cable tensions may be monitored. As shown in FIG. 10, the ouputs of tension sensors I to N are fed to an averaging or a summing circuit 58, the output of which is proportional to the apparent mass added by the damper plate. To prevent the semi-submersible from reaching an unsafe draft, it is necessary to deballast pontoons 16 as the sea state increases, to increase the overall buoyancy. A reference source 60 constantly provides a signal which is proportional to a desired average or summed tension in the support elements 28. The outputs of circuit 58 and source 60 are compared in comparator 62 which provides a control signal to ballasting and deballasting controller 64. A source of compressed air, such as a tank 66, is connected to pontoons 16 via a valve 68, which is operated by controller 64. When deballasting is required, valve 68 is opened to admit pressurized air and valve 70 is opened to release ballast water to increase buoyancy. Of course, when ballasting is required, water is admitted again to pontoons 16, as will be understood by those in the art. The tension sensors I to N may also be used to permit adjusting the tension in each cable to a desired level at deployment. Of course, deballasting may be accomplished equally well by means of pumping the ballast water from the pontoons 16 in lieu of using air pressure, as will be understood by those in the art.

Semi-submersibles operating with a damper plate according to the present invention should achieve substantial economic benefits. Typical down times due to sea conditions run to as many as 30 days per year, at an estimated cost of $50,000 per day. The damping device according to the present invention is estimated to reduce this time to 10 days or better, with a resultant annual savings of about $1,000,000. In addition, the invention will permit existing smaller semi-submersibles to operate in heavier seas than previously thought to be practical. Other potential for increased savings will be apparent to those skilled in the art.

For example, semi-submersibles embodying the present invention will exhibit increased roll and pitch stability due to the location of a large mass far below the center of buoyancy. The resultant increase in metacentric height will permit far greater variation in platform loading than is possible with present semi-submersibles. For example, if the damper plate has a negative buoyancy, when deployed and flooded, of 1,000 long tons, a certain metacentric height will exist with the semi-submersible ballasted to its design draft for drilling. As the seas increase, ballast will be pumped from the pontoons to counter the increased downward pull exerted by the damping plate. With a twenty meter increase in wave height, buoyancy will increase by 6,100 long tons using the dimensions previously discussed. The resisting force of the damping plate increases a like amount, producing approximately a five-fold increase in vertical stiffness. Far greater flexibility in platform loading is thus permissible.

Having described my invention in sufficient detail to enable those in the art to make and use it,

I claim:

1. A semi-submersible apparatus of the type suited for use with off-shore well-drilling equipment, comprising:

a platform element for supporting supplies, equipment and the like at an above-water location;

at least one support column extending beneath said platform element and having a waterplane area large enough to ensure stability when the apparatus is in a semi-submerged condition;

at least one buoyant, ballastable support structure secured to said at least one support column;

the combination of said platform element, said at least one support column and said at least one support structure being buoyantly supported in said semi-submerged condition primarily due to the buoyancy of said at least one support structure;

means for ballasting and deballasting said at least one support structure to produce semi-submerged and floating conditions of said combination, said combination having a maximum heave amplitude occurring in response to open sea waves which have a period essentially equal to the natural heave period of said combination;

a plurality of support members affixed to said combination and extending beneath said combination to at least a depth, below the surface of said water in said semi-submersed condition, at which the amplitude of subsurface wave motion is less than said maximum heave amplitude; and damper means attached to said support members at said depth for providing low resistance to downward movement of said combination and higher resistance to upward movement of said combination, in response to open sea waves.

2. The apparatus of claim 1, wherein said damper means comprises at least one damper plate attached to said support members, said at least one plate including means for permitting a greater flow of water upwardly than downwardly therethrough.

3. The apparatus of claim 2, wherein said at least one damper plate has an area at least three times greater than said waterplane area.

4. The apparatus of claim 2, wherein said at least one damper plate has an area sufficient to produce an equivalent entrained mass of water at least as large as the total mass of said combination.

5. The apparatus according to claim 1, wherein said support members are flexible and tensioned.

6. The apparatus according to claim 5, wherein said support members are chains.

7. The apparatus according to claim 5, wherein said support members are cables.

8. The apparatus according to claim 2, wherein said support members are flexible, tensioned cables or chains, said support members being cross-rigged to prevent sway and surge of said at least one plate relative to said combination.

9. The apparatus according to claim 2, wherein there are a plurality of spaced support columns and a plurality of spaced buoyant, ballastable support structures secured thereto, said at least one plate being sized to permit it to be stored between said buoyant, ballastable support structures, said apparatus further comprising means for drawing said at least one plate to a storage position located between said buoyant, ballastable support structures and above the water-line when said combination is deballasted for transport.

10. An apparatus according to claim 2, wherein said at least one plate comprises a matrix of support beams joined in a rigid frame and said means for permitting water flow comprises a plurality of check valve substructures removably located in said matrix, each substructure including a plurality of upwardly opening check valves.

11. An apparatus according to claim 1, wherein said support members have a length of from one-fourth to one-third of the wave length of open sea waves having a period essentially equal to the natural heave period of said combination.

12. An apparatus according to claim 1, further comprising bottom anchors attached to said damper means.

13. An apparatus according to claim 10, wherein said check valves are flapper valves hinged to said at least one plate, the valves having staggered hinge orientations to minimize transverse movement of said at least one plate as water moves upward through said flapper valves.

14. An apparatus according to claim 2, wherein said at lest one plate includes a water tight structure capable of being ballasted and deballasted to facilitate the lowering and raising of said at least one plate.

15. An apparatus according to claim 5, further comprising means for monitoring the tension in said support elements, and means responsive to said tension monitoring means for actuating said ballasting and deballasting means to increase the buoyancy of said combination as sea state increases, thereby retaining the apparatus at optimum draft in any sea state.

16. An apparatus according to claim 14, wherein said water tight structure comprises a catamaran hull structure for supporting said at least one plate during separate mobilization thereof.

17. Apparatus for damping vertical movement of a vessel, suitable for attachment to a semi-submersible drilling rig or the like having a platform element for support supplies, equipment and the like at an above-water location, at least one support column extending beneath said platform element and having a waterplane area large enough to ensure stability when the apparatus is in a semi-submerged condition, said rig also having at least one buoyant, ballastable support structure secured to said at least one support column, the combination of said platform element and said at least one support column and said at least one support structure being buoyantly supported in said semi-submerged condition primarily due to the buoyancy of said at least one support structure; said rig further including means for ballasting and deballasting said at least one support structure to produce semi-submersed and floating conditions of said combination which has a maximum heave amplitude in response to open sea waves whose period is essentially equal to the natural heave period of said combination, said vertical damping apparatus comprising:

at least one essentially rigid plate including means for permitting a greater flow of water upwardly than downwardly therethrough; and a plurality of support members attached to said at least one plate, said support members being of sufficient length to locate said at least one plate at a depth beneath the surface of said water in said semi-submersed condition, at which the amplitude of subsurface wave motion is less than said maximum heave amplitude.

18. The apparatus of claim 17, wherein said at least one plate has an area at least three times greater than said waterplane area.

19. The apparatus of claim 17, wherein said at least one plate has an area sufficient to produce an equivalent entrained mass of water at least as large as the total mass of said combination.

20. The apparatus of claim 17, wherein said support members are chains or cables.

21. The apparatus of claim 17, wherein said support members are flexible.

22. The apparatus of claim 17, wherein said at least one plate comprises a matrix of support beams joined in a rigid frame and said means for permitting water flow comprises a plurality of check valve substructures removably located in said matrix, each substructure including a plurality of upwardly opening check valves.

23. The apparatus of claim 17, wherein said support members have a length of from one-fourth to one-third of the wave length of open sea waves having a period essentially equal to the natural heave period of said combination.

24. The apparatus of claim 22, wherein said check valves are flapper valves hinged to said at least one plate, the valves having staggered hinge orientations to minimize transverse movement of said at least one plate as water moves upward through said flapper valves.

25. The apparatus of claim 17, wherein said at least one plate includes a water tight structure capable of being ballasted and deballasted to lower and raise said at least one plate.

26. The apparatus of claim 25, wherein said water tight structure comprises a catamaran hull structure for supporting said at least one plate during separate mobilization thereof.

* * * * *